US009139006B2

(12) United States Patent
Kobayashi et al.

(10) Patent No.: US 9,139,006 B2
(45) Date of Patent: Sep. 22, 2015

(54) WIPER DEVICE AND LIQUID EJECTING APPARATUS

(71) Applicant: Seiko Epson Corporation, Tokyo (JP)

(72) Inventors: Hiroyuki Kobayashi, Azumino (JP); Hiroshige Owaki, Okaya (JP); Wataru Takahashi, Chino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/225,127

(22) Filed: Mar. 25, 2014

(65) Prior Publication Data

US 2014/0292919 A1 Oct. 2, 2014

(30) Foreign Application Priority Data

Mar. 27, 2013 (JP) ..... 2013-067656

(51) Int. Cl.
*B41J 2/165* (2006.01)

(52) U.S. Cl.
CPC ..... *B41J 2/16535* (2013.01); *B41J 2002/1655* (2013.01)

(58) Field of Classification Search
USPC ..... 347/33
See application file for complete search history.

(56) References Cited

U.S. PATENT DOCUMENTS

| | | | | |
|---|---|---|---|---|
| 5,239,316 | A * | 8/1993 | Demarchi et al. | 347/33 |
| 5,969,731 | A * | 10/1999 | Michael et al. | 347/33 |
| 2003/0175414 | A1 | 9/2003 | Hayashi | |
| 2005/0062797 | A1 * | 3/2005 | Kachi | 347/33 |
| 2005/0062801 | A1 * | 3/2005 | Kato et al. | 347/45 |
| 2007/0211105 | A1 * | 9/2007 | Furukawa | 347/45 |
| 2012/0050394 | A1 * | 3/2012 | Takada et al. | 347/27 |

FOREIGN PATENT DOCUMENTS

| | | | |
|---|---|---|---|
| JP | 2003-211683 | A | 7/2003 |
| JP | 2004-167488 | A | 6/2004 |
| JP | 2011-126129 | A | 6/2011 |

* cited by examiner

*Primary Examiner* — Stephen Meier
*Assistant Examiner* — Alexander D Shenderov
(74) *Attorney, Agent, or Firm* — Kilpatrick Townsend & Stockton LLP

(57) ABSTRACT

A wiper device allows a liquid ejecting head that ejects a dispersion liquid in which solid particles are dispersed in a liquid from nozzles and a wiping member to move relative to each other so as to wipe the dispersion liquid that adheres to a nozzle formation surface using the wiping member. The wiping member includes a first layer positioned on the nozzle formation surface side, and a second layer positioned on the opposite side to the nozzle formation surface with respect to the first layer. The first layer guides liquid droplets which are dispersion media of the dispersion liquid that adheres to the nozzle formation surface to the second layer through a capillary action and has voids that are able to capture and accommodate a dispersoid of the dispersion liquid. The second layer absorbs the dispersion media.

19 Claims, 4 Drawing Sheets

WIPER DEVICE AND LIQUID EJECTING APPARATUS

BACKGROUND

1. Technical Field

This application claims priority to Japanese Patent Application No. 2013-067656 filed on Mar. 27, 2013. The entire disclosure of Japanese Patent Application No. 2013-067656 is hereby incorporated herein by reference.

The present invention relates to a wiper device which wipes a nozzle formation surface of a liquid ejecting head, and a liquid ejecting apparatus including the wiper device.

2. Related Art

Hitherto, as a type of liquid ejecting apparatus, an ink jet printer which performs printing by ejecting ink (liquid) from nozzles formed in a liquid ejecting head toward a medium such as a sheet is known. In addition, in such a printer, typically, in order to maintain the property of ejecting ink from the nozzles, a maintenance device is provided (for example, refer to JP-A-2011-126129).

As the maintenance device, there is a device that includes a cleaning unit which wipes ink that adheres to a nozzle formation surface having nozzles formed therein, in a liquid ejecting head. In this case, the cleaning unit includes a carriage that is moved by a driving force transmitted from a motor, and a first reel and a second reel which are provided on the side surfaces of the carriage to rotate. In addition, a long cleaning tape is suspended between the first reel and the second reel.

In addition, in the maintenance device, in a state where a part of the cleaning tape which is suspended between the first reel and the second reel abuts on the liquid ejecting head, the carriage is moved by the driving force transmitted from the motor such that the ink is wiped off the nozzle formation surface of the liquid ejecting head.

However, in the printer described above, there may be cases where ink which is a dispersion liquid containing particles as a dispersoid is used. As an example of the ink, there is a pigment ink used when high-resolution printing is performed. In addition, when the pigment ink is used, pigment particles contained in the pigment ink captured by the cleaning tape during the wiping slide in the movement direction of the carriage with respect to the nozzle formation surface of the liquid ejecting head while being interposed between the nozzle formation surface of the liquid ejecting head and the cleaning tape. As a result, there is concern that the nozzle formation surface of the liquid ejecting head is damaged by the pigment particles and there is a problem of damage to the nozzle formation surface due to the wiping.

In addition, this problem is not limited only to ink jet printers and is common to a wiper device which wipes a liquid off a nozzle formation surface of a liquid ejecting head capable of ejecting liquid and a liquid ejecting apparatus including a wiper device.

SUMMARY

An advantage of some aspects of the invention is that it provides a wiper device and a liquid ejecting apparatus capable of suppressing damage to a nozzle formation surface of a liquid ejecting head during wiping.

According to an aspect of the invention, there is provided a wiper device which allows a liquid ejecting head that ejects a dispersion liquid in which solid particles are dispersed in a liquid from nozzles and a wiping member to move relative to each other so as to wipe the dispersion liquid that adheres to a nozzle formation surface using the wiping member, in which the wiping member includes a first layer positioned on the nozzle formation surface side, and a second layer positioned on the opposite side to the nozzle formation surface with respect to the first layer, the first layer has voids that guide liquid droplets which are dispersion media of the dispersion liquid that adheres to the nozzle formation surface to the second layer through a capillary action and are able to capture and accommodate a dispersoid of the dispersion liquid, and the second layer absorbs the dispersion media.

According to this aspect, as the first layer of the wiping member abuts on the nozzle formation surface, the liquid droplets that adhere to the nozzle formation surface are guided to the second layer by the capillary action. As a result, the liquid droplets that adhere to the nozzle formation surface can be removed and cleaned. In addition, the liquid droplets that are guided to the second layer are absorbed by the second layer. That is, the first layer pulls the liquid droplets of the nozzle formation surface into the second layer, and the second layer absorbs the pulled liquid droplets.

On the other hand, the dispersoid of the dispersion liquid is captured and accommodated in the voids of the first layer when being guided to the second layer. Therefore, the dispersoid is not present while adhering to the surface of the wiping member, and the dispersoid that is guided once to the second layer from the first layer does not also appear on the surface of the wiping member. That is, damage to the nozzle formation surface by the dispersoid generated when the nozzle formation surface is wiped while the dispersoid adheres to the surface of the wiping member, particularly, damage to a water-repellent film that coats the nozzle formation surface may be prevented beforehand.

Here, the first layer and the second layer may be formed of the same material, the first layer may have a number of projections which extend from a surface of the second layer in a direction perpendicular to the surface, and the voids may be formed in recesses between the adjacent projections. In this case, the desired wiping member can be simply formed only by forming the recesses of the same material. In addition, the first layer may be appropriately formed of a fabric by weaving warp threads and weft threads. In this case, the capillary action that the fabric originally has can be appropriately used, and the voids are formed by stitches, so that the dispersoid can be properly captured and accommodated in the stitches.

In addition, the first layer may be configured to have a number of grooves that extend from the nozzle formation surface toward the second layer so as to allow the liquid droplets which are the dispersion media to be guided to the second layer along the grooves and be formed of a flexible member which captures and accommodates the dispersoid in the grooves to abut on a surface of the second layer. In this case, the flexible member is allowed to appropriately abut on the nozzle formation surface and wipe off the liquid droplets that adhere to the nozzle formation surface and guides the wiped liquid droplets to the second layer along the grooves so as to be properly absorbed by the second layer. At this time, the dispersoid contained in the liquid droplets can be properly captured and accommodated in the grooves.

The dispersion liquid may include an inorganic pigment which is harder than a coating film of the nozzle formation surface as the dispersion medium. Even when the inorganic pigment that is harder than the coating film is included as the dispersion medium, the wiped dispersoid does not remain on the surface of the wiping member, and thus the nozzle formation surface is not damaged.

In addition, the recesses may be formed by embossing.

In addition, a thread diameter of the warp thread and a thread diameter of the weft thread may be greater than a nozzle diameter of the nozzle.

In addition, the warp threads and the weft threads may be microfibers.

In addition, the fabric may be plain-woven or knit-woven.

In addition, a plurality of rollers may be included, and the wiping member may have a long band shape wound around the plurality of rollers.

The liquid ejecting head may move in a main scanning direction, and the wiping member may move in a sub-scanning direction while abutting on the nozzle formation surface.

In addition, the wiping member may move in a direction perpendicular to the nozzle formation surface.

According to another aspect of the invention, there is provided a liquid ejecting apparatus including the wiper device.

According to the aspect, wiping of the nozzle formation surface of the recording head can be appropriately and properly performed, and thus printing quality and the like can be properly maintained over a long period of time.

In addition, there is provided a method of wiping a nozzle formation surface of a liquid ejecting head which ejects a dispersion liquid in which solid particles are dispersed in a liquid from nozzles, including: allowing a first layer of a wiping member which includes the first layer and a second layer to abut on the nozzle formation surface; guiding dispersion media of the dispersion liquid that adheres to the nozzle formation surface to the second layer along the first layer so as to be absorbed by the second layer; and capturing and accommodating a dispersoid of the dispersion liquid that adheres to the nozzle formation surface in the voids of the first layer.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described in detail with reference to the drawings.

Figure 1:
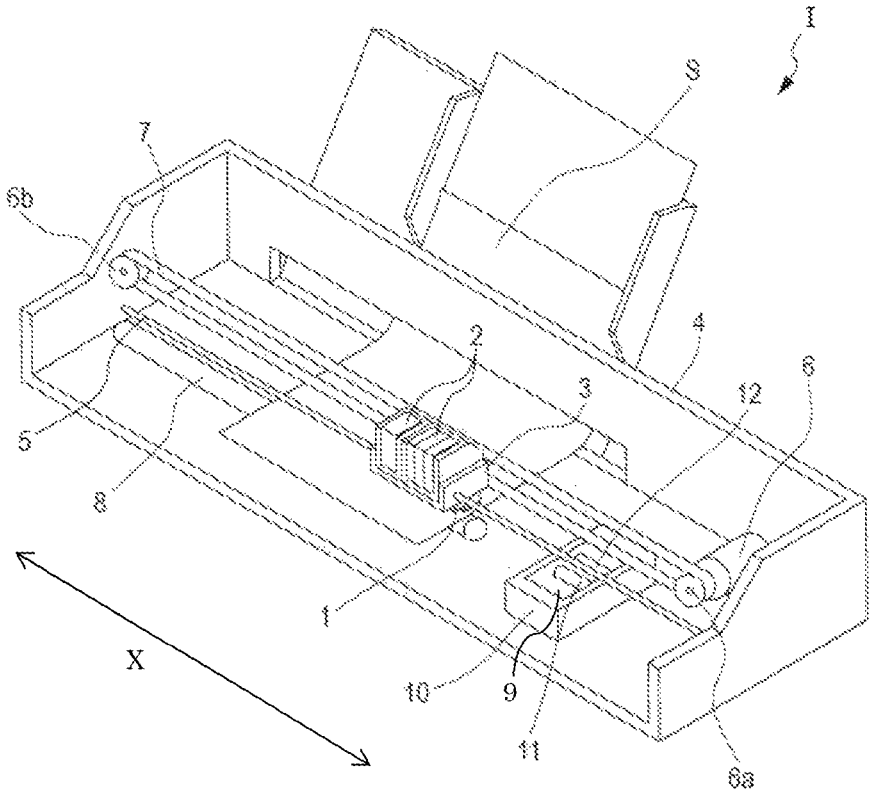
FIG. 1 is a schematic diagram of the configuration of an ink jet recording apparatus according to an embodiment of the invention.

FIG. 1 is a schematic perspective view of an ink jet recording apparatus which is an example of a liquid ejecting apparatus according to an embodiment of the invention. As illustrated in FIG. 1, the ink jet recording apparatus I according to this embodiment includes an ink jet recording head (hereinafter, simply referred to as a recording head) 1, and additionally, an ink cartridge 2 as a supply unit that supplies ink to the recording head 1 is detachably provided. A carriage 3 in which the recording head 1 is mounted is provided to be movable in the axial direction along a carriage shaft 5 mounted to an apparatus body 4. The recording head 1 discharges a black ink composition and color ink compositions. That is, ink which is a dispersion liquid in which solid particles are dispersed in a liquid, for example, a pigment ink is discharged from nozzles.

In addition, in the vicinity of one end portion of the carriage shaft 5, a drive motor 6 is provided, and a first pulley 6*a* having a groove on the outer circumference is provided at the front end portion of the drive motor 6. Moreover, in the vicinity of the other end portion of the carriage shaft 5, a second pulley 6*b* corresponding to the first pulley 6*a* of the drive motor 6 is provided to rotate, and a timing belt 7 made of an annular elastic member such as rubber is suspended between the first pulley 6*a* and the second pulley 6*b*.

In addition, as the driving force of the drive motor 6 is transmitted to the carriage 3 via the timing belt 7, the carriage 3 in which the recording head 1 is mounted is moved in a main scanning direction X along the carriage shaft 5. On the other hand, in the apparatus body 4, a platen 8 is provided along the carriage 3. The platen 8 can be rotated by driving force of a paper transport motor (not illustrated), and a recording sheet S which is a recording medium such as paper fed by a paper feed roller or the like is wound around the platen 8 and is transported in a sub-scanning direction.

In the apparatus body 4, at a home position provided at a position outside a region where the recording sheet S is transported, a wiper device 9 is disposed for maintenance (cleaning) of a nozzle formation surface of the recording head 1.

Figure 2:
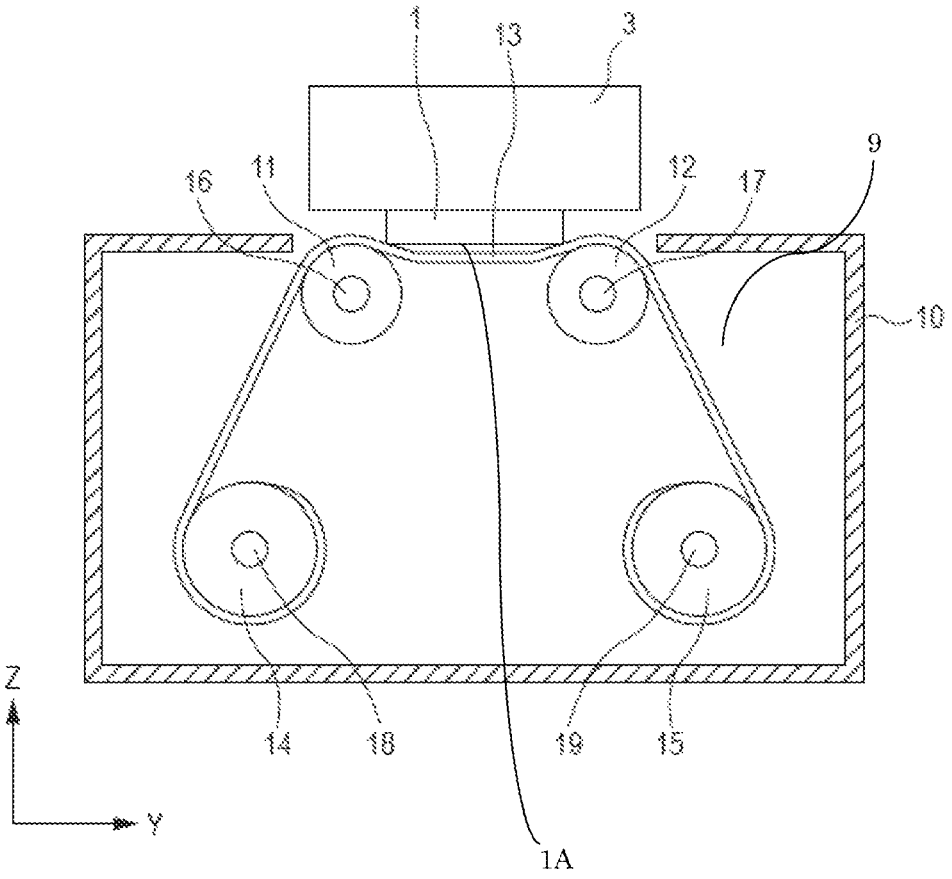
FIG. 2 is a schematic diagram illustrating the configuration of a wiper device of the embodiment.

FIG. 2 is a schematic diagram illustrating a detailed configuration by extracting and enlarging the wiper device. As illustrated in FIG. 2, the wiper device 9 includes rollers 11, 12, 14, and 15 that rotate about horizontal axes along rotating shafts 16, 17, 18, and 19 horizontally held in a housing 10. A wiping member 13 is wound around the rollers 14 and 15. The rollers 11 and 12 are disposed between the rollers 14 and 15, abut on the lower surface of the wiping member 13 therebelow, and are raised in a vertical direction Z in a state of abutting on the lower surface such that the surface of the wiping member 13 abuts on a nozzle formation surface 1A of the recording head 1 at a predetermined pressing force. The entirety of the wiper device 9 including the housing 10 is moved in the sub-scanning direction Y in the state where the surface of the wiping member 13 abuts on the nozzle formation surface 1A of the recording head 1. Accordingly, the nozzle formation surface 1A is wiped by the surface of the wiping member 13. Here, the wiping member 13 will be described with reference to FIGS. 3 and 4.

Figure 3:
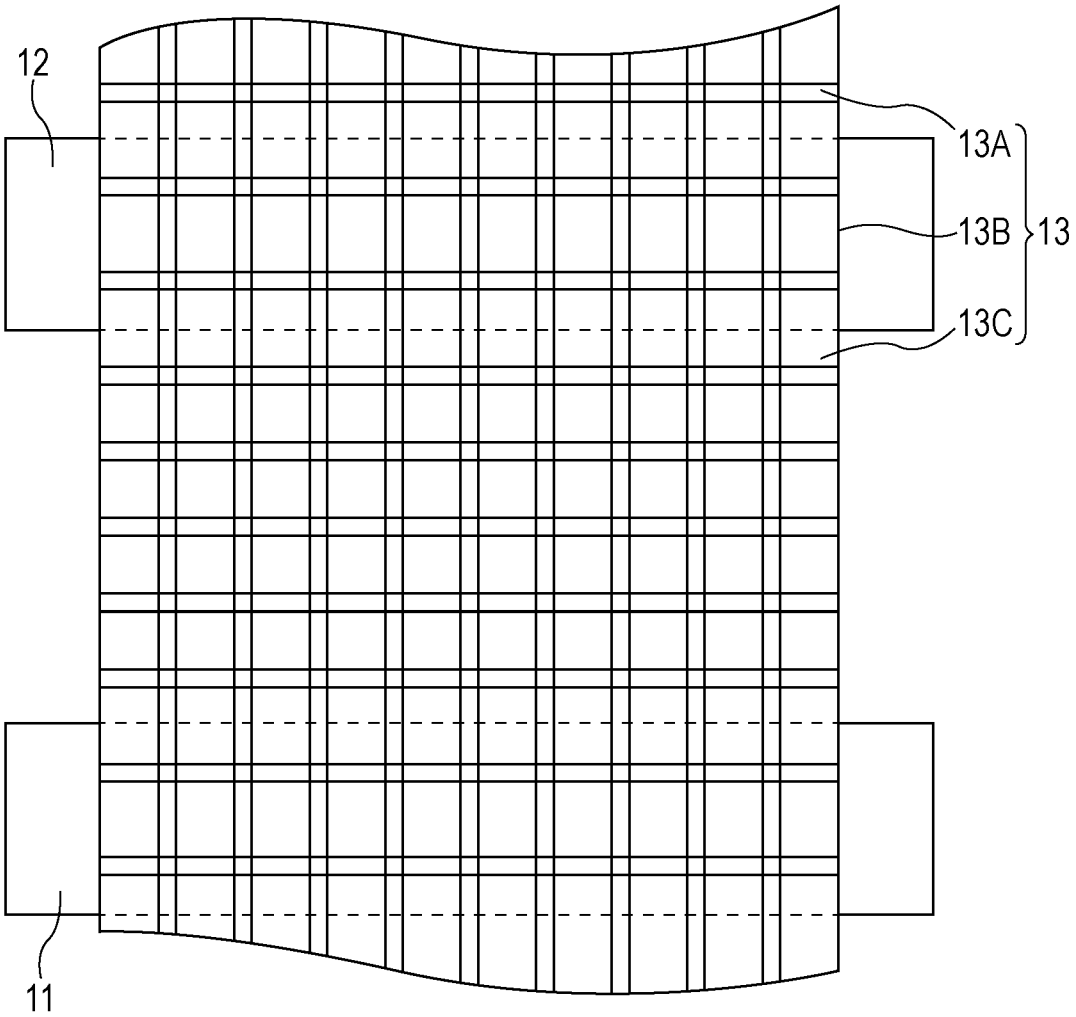
FIG. 3 is a plan view of a wiping member suspended between rollers of the embodiment.
Figure 4:
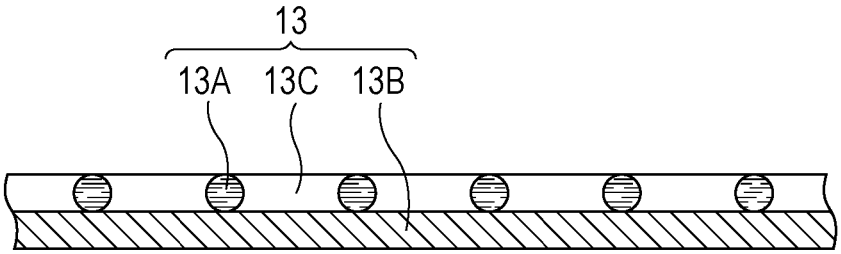
FIG. 4 is a cross-sectional view of the wiping member of the embodiment.

FIG. 3 is a plan view of the wiping member wound around the rollers, and FIG. 4 is a cross-sectional view of the wiping member of FIG. 3. As illustrated in FIGS. 3 and 4, the wiping member 13 has a double layer structure including a first layer 13A on the nozzle formation surface 1A (see FIG. 2, the same applies hereinafter) side, that is, the upper surface side, and a second layer 13B on the opposite side to the nozzle formation surface 1A with respect to the first layer 13A, that is, the lower surface side. Here, the first layer 13A includes voids 13C (although illustration is enlarged for the simplification of the figures, in practice, extremely small spaces in units of micrometers) capable of guiding the dispersion liquid that abuts on the nozzle formation surface 1A and adheres to the nozzle formation surface 1A to the second layer 13B by the capillary action, for example, liquid droplets which are the dispersion media of the pigment ink, and capturing and accommodating pigment particles which is the dispersoid of the pigment ink. On the other hand, the second layer 13B is a sheet-like member that absorbs and holds the pigment particles (the dispersion media).

More specifically, the first layer 13A may be appropriately formed of a fabric having a small thread density, that is, a plain-woven or knit-woven fabric having large voids 13C. In addition, from the viewpoint of the capillary action and the property of capturing particles, microfiber, ultra-fine fiber, or the like may also be appropriately applied. Here, it is preferable that the fabric that forms the first layer 13A have a thread diameter greater than the nozzle diameter of the recording head 1 (see FIG. 2). This is for preventing pieces of the thread from infiltrating into the recording head 1 from the nozzles as foreign matter.

On the other hand, the second layer 13B may be appropriately formed of a sheet-like member which has high absorbency and absorbs and holds ink. For example, non-woven fabric, polyester, sponge, or the like is appropriate.

According to this embodiment, as the first layer 13A of the wiping member 13 abuts on the nozzle formation surface 1A, the ink droplets including a solid pigment and the like which are the dispersion media that adhere to the nozzle formation surface 1A are guided to the second layer 13B by the capillary action. As a result, the ink droplets that adhere to the nozzle formation surface 1A can be removed and cleaned. In addition, the ink droplets that are guided to the second layer 13B are absorbed by the sheet-like second layer 13B. That is, the first layer 13A pulls the ink droplets of the nozzle formation surface 1A into the second layer 13B, and the second layer 13B absorbs and holds the pulled ink droplets.

On the other hand, the solid particles which are the dispersoid are captured and accommodated in the voids 13C of the first layer 13A when being guided to the second layer 13B. Therefore, the particles that are the dispersoid do not adhere to the surface of the wiping member 13. In addition, the particles that are the dispersoid guided once to the second layer 13B from the first layer 13A do not appear on the surface of the wiping member 13. That is, damage to the nozzle formation surface 1A by the particles which are the hard dispersoid generated when the nozzle formation surface 1A is wiped while the particles as the dispersoid adhere to the surface of the wiping member 13, particularly, damage to a water-repellent film that coats the nozzle formation surface 1A may be prevented beforehand.

Figure 5:
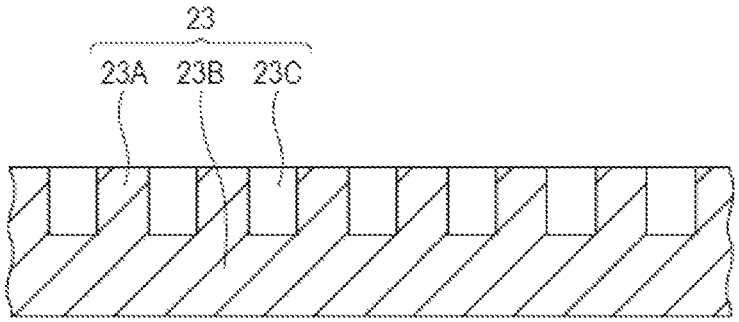
FIG. 5 is a cross-sectional view of a wiping member of another embodiment.

As described above, in the wiping member 13 of the invention, the first layer 13A may have functions of inducing the ink droplets by the capillary action and capturing and accommodating the particles, and the second layer 13B may have high absorbency for the ink droplets. Therefore, when the functions of the first layer 13A and the second layer 13B are provided, the first layer and the second layer may be formed of the same material. Moreover, the first layer and the second layer may be formed continuously so that there is no clear boundary therebetween. A wiping member formed of the same material is illustrated in FIG. 5. As illustrated in FIG. 5, in a wiping member 23 according to this embodiment, a first layer 23A has a number of projections which extend from the surface of a second layer 23B in a direction perpendicular to the surface, and voids 23C are formed in recesses between the adjacent projections. The recesses in this embodiment may be easily formed by, for example, embossing.

According to this embodiment, the desired wiping member 23 can be simply formed only by forming the recesses of the same material.

Figure 6:
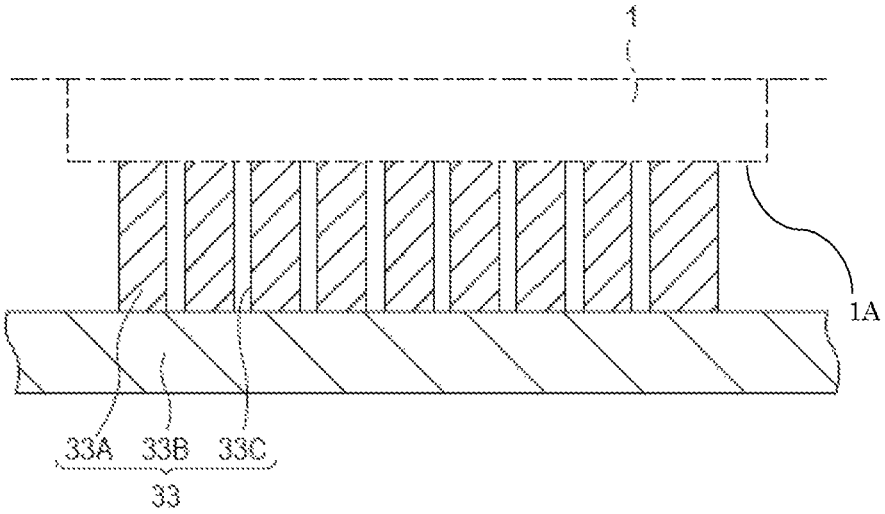
FIG. 6 is a cross-sectional view of a wiping member of still another embodiment.

Moreover, as illustrated in FIG. 6, a first layer 33A may be formed to have grooves 33C which are a number of voids that extend from the nozzle formation surface 1A toward a second layer 33B so that the ink droplets which are the dispersion media are guided to the second layer 33B along the grooves 33C which are the voids. Here, the grooves 33C as the voids are configured to capture and accommodate the particles which are the dispersoid therein. This configuration can be easily implemented by, for example, forming the first layer 33A of a flexible member such as a rubber member to abut on the surface of the second layer 33B.

According to this embodiment, the first layer 33A which is the flexible member is allowed to abut on the nozzle formation surface 1A and wipe off the ink droplets that adhere to the nozzle formation surface 1A and guides the wiped ink droplets to the second layer 33B along the grooves 33C so as to be properly absorbed by the second layer 33B. At this time, the particles that are the dispersoid contained in the ink droplets can be properly captured and accommodated in the grooves 33C.

In addition, in the embodiments described above, the ink which is the dispersion liquid may include an inorganic pigment which is harder than the coating film of the nozzle formation surface 1A as the dispersoid. Even when the inorganic pigment that is harder than the coating film is included as the dispersoid, the wiped dispersoid does not remain on the surface of the wiping member 13, 23, or 33, and thus the nozzle formation surface 1A is not damaged.

In the embodiments described above, the shape of the wiping member 13, 23, or 33 is not necessarily a long band shape wound between the rollers 18 and 19 but may employ any shape such as a sheet shape as long as the nozzle formation surface 1A of the recording head 1 can be wiped.

In the embodiments described above, the liquid ejecting apparatus may be a liquid ejecting apparatus which ejects or discharges a liquid other than the ink. In addition, the state of the liquid discharged as a minute amount of liquid droplets from the liquid ejecting apparatus includes granular, tear-like, and thread-like shapes with trails. The "liquid" mentioned herein may be a material that can be ejected from the liquid ejecting apparatus. For example, the liquid may be a material in a state where the material has a liquid phase, includes liquid-phase materials with high or low viscosities, sol, gel water, and fluid-phase materials such as inorganic solvents, organic solvents, solutions, liquid-phase resin, and liquid-phase metals (metallic melts). In addition to liquids as a state of a material, the liquid also includes a material in which particles of functional materials made of solids such as pigments or metallic particles are dissolved, dispersed, or mixed with the solvent. As a representative example of the liquid, there is the ink described above in the embodiments or liquid crystals or the like. Here, the ink may include various types of liquid compositions such as general water-based ink, oil-based ink, gel ink, and hot-melt ink.

Specific examples of the liquid ejecting apparatus include liquid crystal displays, electroluminescence (EL) displays, surface light-emitting displays, and liquid ejecting apparatuses for ejecting liquids in which materials such as electrode materials used for manufacturing color filters and color materials are dispersed or dissolved. In addition, the liquid ejecting apparatus may be a liquid ejecting apparatus that ejects a biological organic material used for manufacturing biochips, a liquid ejecting apparatus that ejects a specimen used as a precision pipette, a printing apparatus, or a micro-dispenser. Moreover, the liquid ejecting apparatus may be a liquid ejecting apparatus that ejects lubricating oil to precision machinery such as watches or cameras with pinpoint precision, or a liquid ejecting apparatus that ejects a transparent resin liquid such as a ultraviolet curable resin liquid to a substrate to form a micro-hemispherical lens (optical lens) or the like used for optical communication elements and the like. In addition, the liquid ejecting apparatus may be a liquid ejecting apparatus that ejects an acidic or alkaline etchant for etching a substrate and the like.

What is claimed is:

1. A wiper device which allows a wiping member and a liquid ejecting head that ejects a dispersion liquid from nozzles to move relative to each other so as to wipe the dispersion liquid that adheres to a nozzle formation surface of the liquid ejecting head using the wiping member, wherein the dispersion liquid comprises dispersion media and a dispersoid;

wherein the wiping member comprises:

a first layer positioned on the nozzle formation surface side of the wiping member, and a second layer positioned on the side of the wiping member opposite to the nozzle formation surface with respect to the first layer, wherein the first layer comprises:

threads with a thread diameter, wherein the thread diameter is greater than a nozzle diameter of the nozzles; and voids that guide the dispersion media that adheres to the nozzle formation surface to the second layer through a capillary action and are able to capture and accommodate the dispersoid, and wherein the second layer absorbs the dispersion media.

2. The wiper device according to claim 1, wherein the first layer and the second layer are formed of the same material, the first layer has a number of projections which extend from a surface of the second layer in a direction perpendicular to the surface, and the voids are recesses between the adjacent projections.

3. The wiper device according to claim 2, wherein the recesses are formed by embossing.

4. A liquid ejecting apparatus comprising the wiper device according to claim 3.

5. A liquid ejecting apparatus comprising the wiper device according to claim 2.

6. The wiper device according to claim 1, wherein the first layer is formed of a fabric by weaving warp threads and weft threads, wherein a thread diameter of the warp threads and a thread diameter of the weft threads are greater than the nozzle diameter.

7. The wiper device according to claim 6, wherein the warp threads and the weft threads are microfibers.

8. A liquid ejecting apparatus comprising the wiper device according to claim 7.

9. The wiper device according to claim 6, wherein the fabric is plain-woven or knit-woven.

10. A liquid ejecting apparatus comprising the wiper device according to claim 9.

11. A liquid ejecting apparatus comprising the wiper device according to claim 6.

12. The wiper device according to claim 1, wherein the first layer has voids are grooves that extend from the nozzle formation surface toward the second layer so as to allow the dispersion media to be guided to the second layer along the grooves, wherein the first layer is formed of a flexible member which captures and accommodates the dispersoid in the grooves to abut on a surface of the second layer.

13. The wiper device according to claim 1, wherein the dispersoid is an inorganic pigment which is harder than a coating film of the nozzle formation surface.

14. The wiper device according to claim 1, further comprising a plurality of rollers, wherein the wiping member has a long band shape wound around the plurality of rollers.

15. The wiper device according to claim 14, wherein the liquid ejecting head moves in a main scanning direction, and the wiping member moves in a sub-scanning direction while abutting on the nozzle formation surface.

16. The wiper device according to claim 1, wherein the wiping member moves in a direction perpendicular to the nozzle formation surface.

17. A liquid ejecting apparatus comprising the wiper device according to claim 1.

18. A method of wiping a nozzle formation surface of a liquid ejecting head which ejects a dispersion liquid from nozzles, wherein the dispersion liquid comprises dispersion media and a dispersoid, the method comprising:

allowing a first layer of a wiping member to abut on the nozzle formation surface, wherein the first layer comprises threads with a thread diameter, wherein the thread diameter is greater than a nozzle diameter of the nozzles;

guiding the dispersion media of the dispersion liquid that adheres to the nozzle formation surface to a second layer of the wiping member along voids defined in the first layer so that the dispersion media is absorbed by the second layer; and capturing and accommodating the dispersoid that adheres to the nozzle formation surface in the voids of the first layer.

19. A wiper device, comprising:

a liquid ejecting head comprising a nozzle surface defining nozzles therein, the nozzles comprising a substantially uniform nozzle diameter, wherein the liquid ejecting head is configured to eject a dispersion liquid through the nozzles, the dispersion liquid comprising a dispersion medium and a dispersoid; and a wiping member configured to move relative to the liquid ejecting head to thereby wipe a portion of the dispersion liquid that adheres to the nozzle surface of the liquid ejecting head using the wiping member, the wiping member comprising:

a first layer positioned adjacent the nozzle surface; and a second layer positioned on an opposite side of the wiping member distal to the nozzle surface, wherein the first layer comprises:

threads with a thread diameter, wherein the thread diameter is greater than the nozzle diameter; and voids configured and dimensioned to guide the dispersion media that adheres to the nozzle surface to the second layer through capillary action, the voids further being configured and dimensioned to capture and accommodate the dispersoid, and wherein the second layer is configured to absorb the dispersion media.

* * * * *